United States Patent [19]

Allen et al.

[11] 4,394,004

[45] Jul. 19, 1983

[54] CARPET STRETCHING TOOL

[76] Inventors: James R. Allen, 3130 S. 17th St., Omaha, Nebr. 68108; John D. Allen, 10302 S. 144th St., Omaha, Nebr. 68138; Robert A. Knigge, 11808 Cryer Ave., Omaha, Nebr. 68144

[21] Appl. No.: 266,488

[22] Filed: May 22, 1981

[51] Int. Cl.[3] ..... B65H 77/00

[52] U.S. Cl. ..... 254/204

[58] Field of Search ..... 254/204, 212, 231, 200; 294/8.6; 16/5; 700/289, 290; 24/69 TM

[56] References Cited

U.S. PATENT DOCUMENTS

| | | | |
|---|---|---|---|
| 651,924 | 6/1900 | Johnson | 254/204 |
| 834,535 | 10/1906 | Poirot | 254/204 |
| 888,689 | 5/1908 | Bradbury | 254/204 |

*Primary Examiner*—Billy S. Taylor

*Attorney, Agent, or Firm*—George R. Nimmer

[57] ABSTRACT

Disclosed are carpet stretching tools comprising a pair of laterally extending and parallel barbed bars including a lead-bar and a trail-bar, guide means permitting longitudinal movement between the barbed bars while maintaining them in parallelism, and force application means to forceably controllably move the carpet engageable barbed bars into proximity. Preferably, the guide means takes the form of slidably engaged collar and shank, and the force application means includes a longitudinally extending threaded stud firmly attached to one barbed bar and movably surrounded by the other barbed bar, and further includes a controllable handle. Loftily disposed guide shank and force application threaded stud might provide the sole connection between barbed bars to permit ancillary manual operations to be performed therebelow. The barbed bars might be of selectable lateral length appropriate to certain carpet stretching tasks.

8 Claims, 4 Drawing Figures

Figure 1:
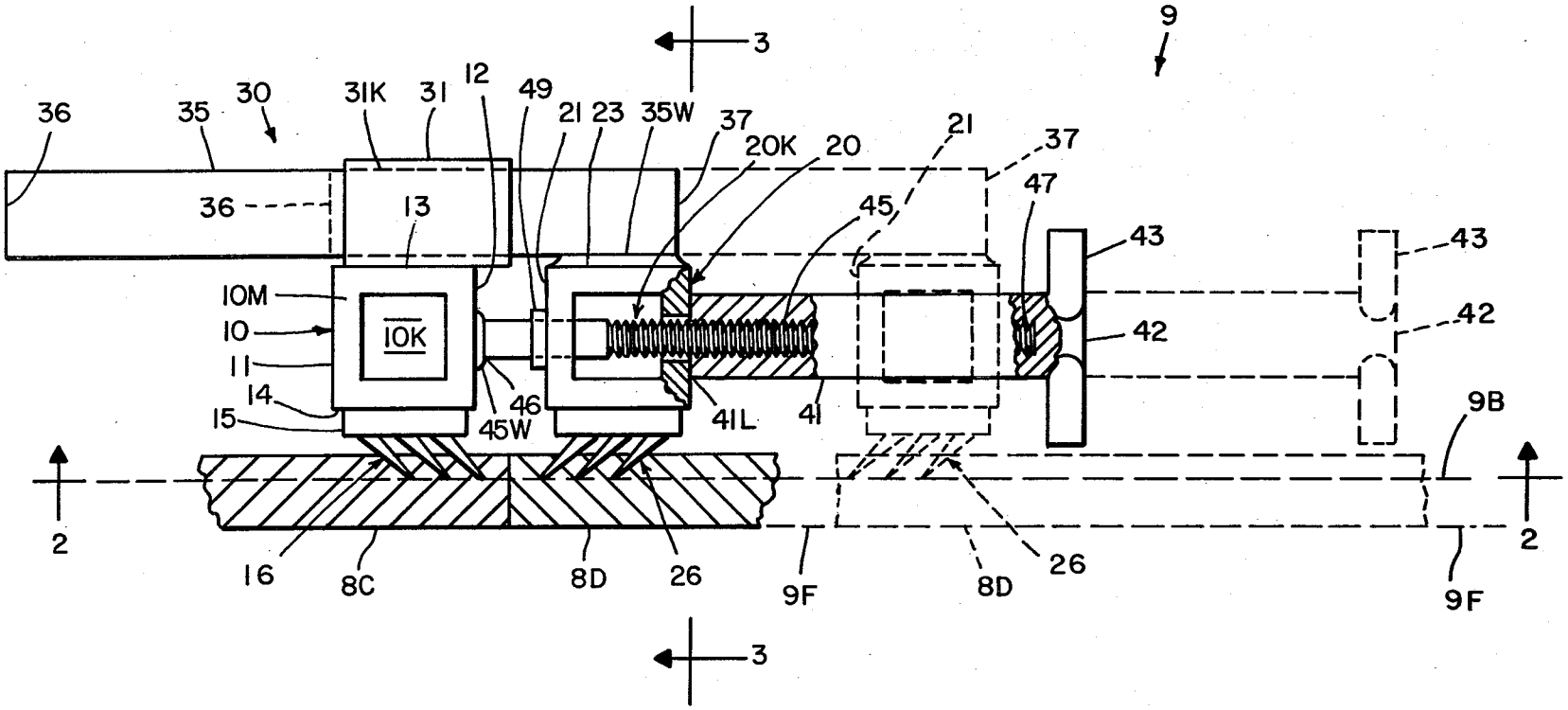

FIG. 4
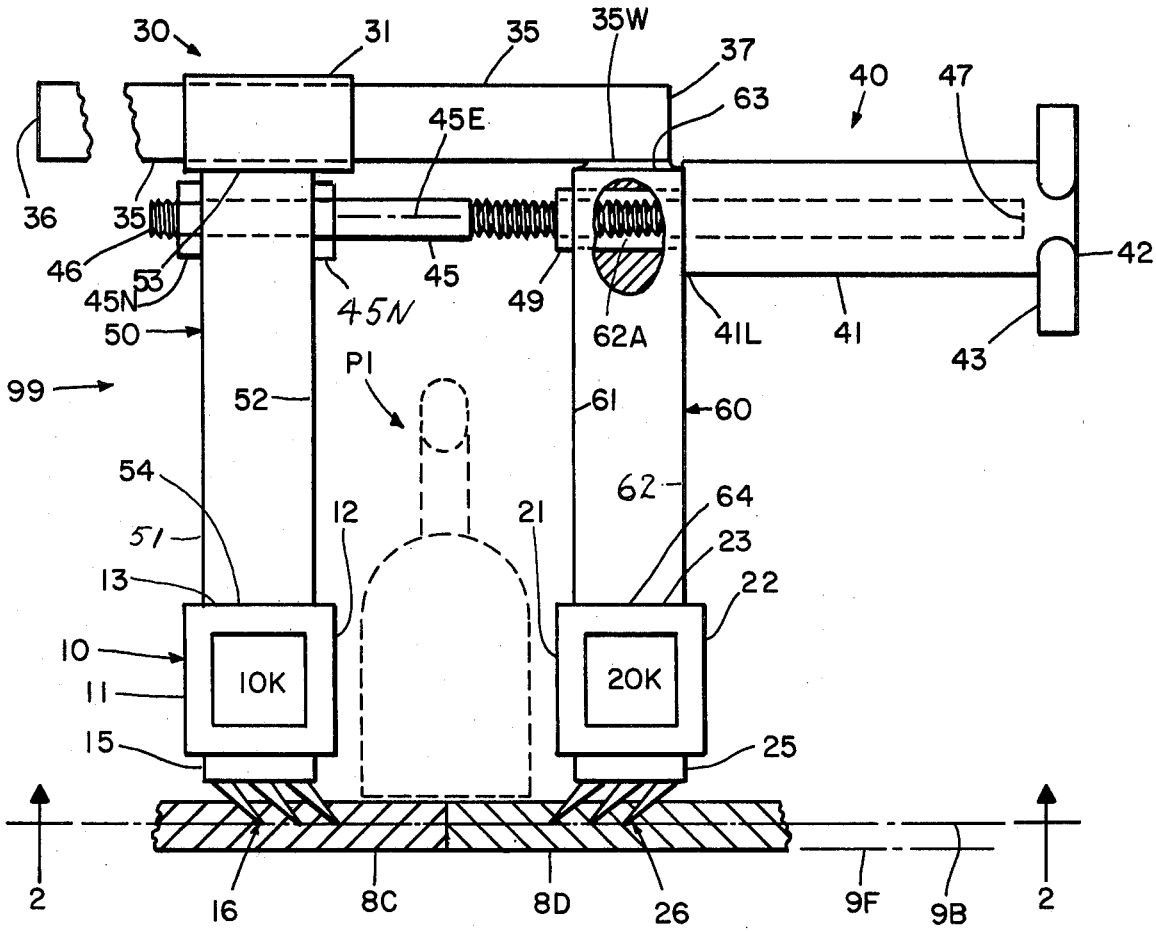
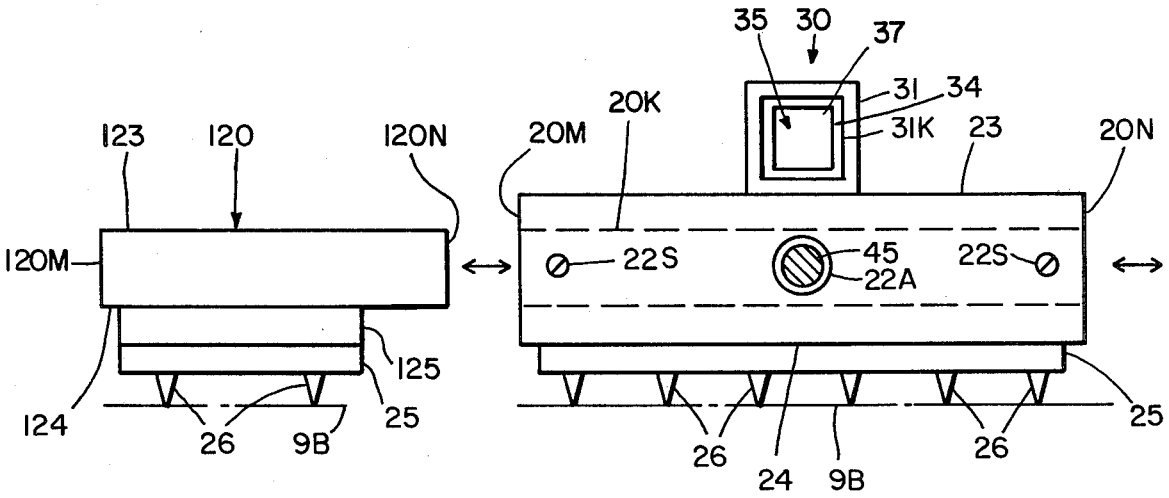
FIG. 3

CARPET STRETCHING TOOL

Carpet floor covering is usually provided as distinct strips, normally of 12-feet width, whereby carpet installation (and subsequent seam repair) entails stretching the carpet strips into abutting proximity for attachment to the underlying flooring. As exemplified by U.S. Pat. No. 300,396, over the past decades prior art workers have been attepting to develop carpet stretching tools amenable to the variety of tasks confronting them. However, carpet stretching tools heretofore developed have been plagued by one or more of the following inherent disadvantages and deficiencies. The force application means portion tends to be bulky and cumbersome, making the tools inapprooriate for use in confined or cramped areas. Prior art tools tend to entail unduly multiplied repetitive operations that detract from speed and efficiency in covering larger rooms with carpeting. Structures of the prior art tools have such predominate emphasis upon the installation of carpeting that they inherently lack ready capability for repairing seams of existent carpeting. Most prior art tools are not amenable to ancillary tasks to be performed upon the carpeting being stretched, such as the ancillary joinder of the abutting carpet strips.

It is accordingly the general objective of the present invention to provide improved carpet streching tools amenable to a variety of tasks confronting those in the floor covering trade and that overcome the disadvantages and deficiencies of prior art tools.

One of the specific objectives of the present invention is to provide a carpet stretching tool that can be made in compact lightweight form, to permit its effective use in confined and cramped areas, such as along narrow obstructions, under the steps of "open" staircases, etc.

Another of the specific objectives is to provide a carpet stretching tool that is adaptable for use in installing carpeting in rooms of various sizes, but wherein the number of carpet stretching maneuvers need not be proportionately multiplied for larger rooms.

Another of the specific objectives is to provide a carpet stretching tool that has unusual capability for both original installation and seam repair of existent carpeting.

Another of the specific objectives is to provide a carpet stretching tool that is amenable to the performance of ancillary tasks at the proximal abutting terminii of the carpet being stretched, such as the anchoring or other treatment of the abutting carpeting.

Consistent with the general and specific objectives of the present invention, ancillary objectives include carpet stretching tools that are reliable in operation and performance, that are sturdy and relatively light in weight, that are simple and efficient to use, and that are of economical cost to build and to maintain.

With the above and other objects and advantages in view, which will become more apparent as this description proceeds, the carpet stretching tools concept of the present invention generally comprises: a pair of laterally extending parallel barbed bars including a lead-bar and a trail-bar; guide means (preferably including a collar slidably surrounding a lengthy shank) located above the barbs and permitting longitudinal movement between the barbed bars while maintaining them in substantial parallelism; force application means (preferably including a longitudinal threaded stud with twistable handle) to forceably and controllably longitudinally move the carpet engageable barbed bars into proximity; and together with other permissible novel structural features, such as barbed bars of selectively variable lateral extent, guide and force application means serving as the sole and loftily-arched connection between the barbed bars, exceedingly compact forms for use with "open" staircases or other confined areas, etc.

Figure 2:
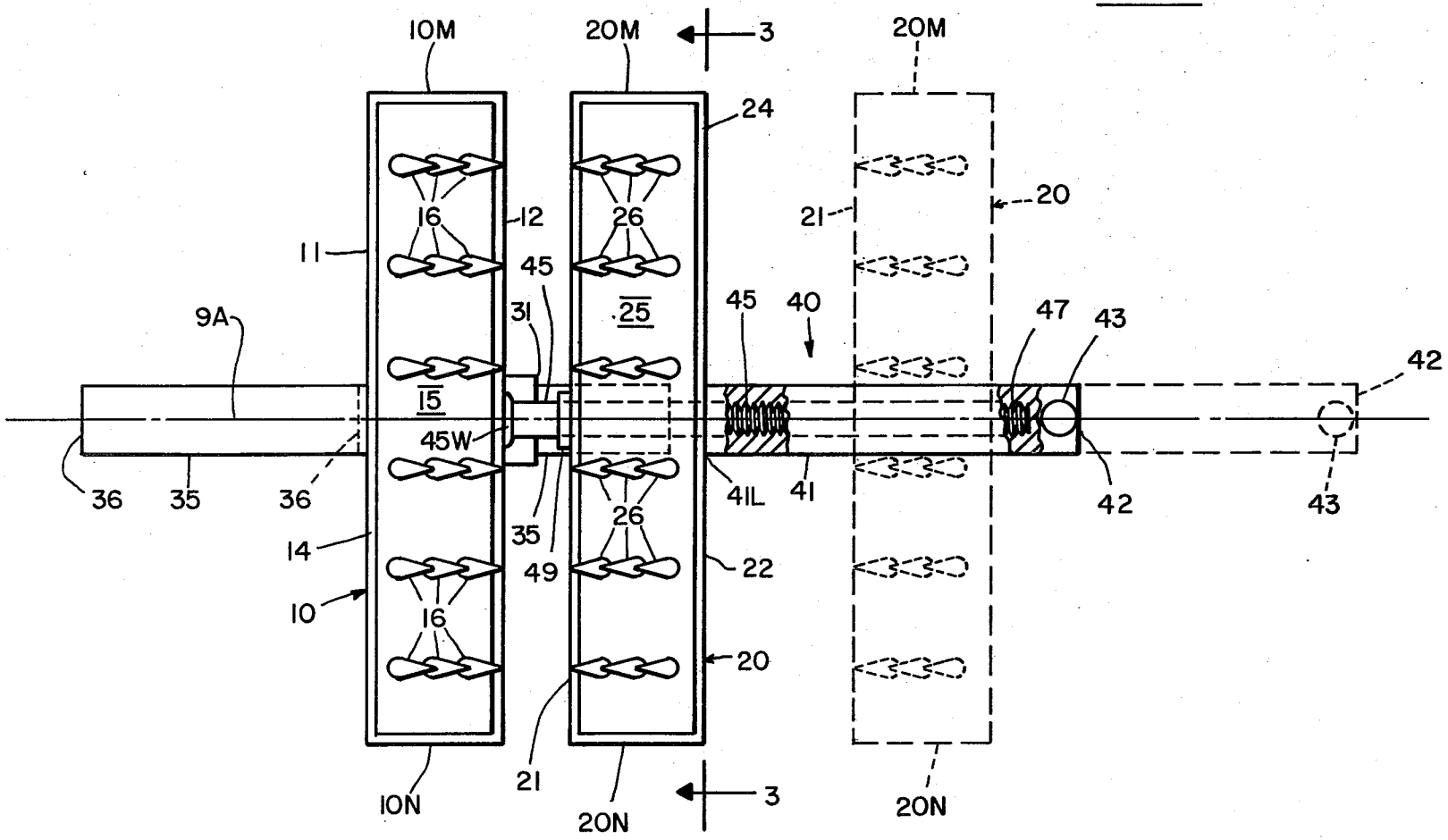

In the drawing, wherein like characters refer to like parts in the several views, and in which:

FIG. 1 is a longitudinally extending elevational view, partly in section, of a primary embodiment of the carpet stretching tool concept of the present invention;

FIG. 2 is a bottom plan view, partly in section, of the FIG. 1 primary embodiment. Phantom lines in FIGS. 1 and 2 indicate the locations of the barbed trail-bar, the guide means shank, and the force application twistable handle, prepatory to moving trailward carpet length (8D) into abutting proximity with leadward carpet length (8C), solid lines in FIGS. 1 and 2 indicate the same tool components after the attainment of carpet abutment;

FIG. 3 is a sectional elevational view taken along lines 3—3 of FIGS. 1 and 2, and further shows the optional capability for a selectively variable lateral extent for the barbed bars; and FIG. 4 is a longitudinally extending elevational view, partly in section, of a modified tool embodiment wherein the guide and force application means function as the sole and loftily-arched connection means between the barbed bars to permit the performance of ancillary manual operations therebelow along the abutting carpets.

Turning initially to FIGS. 1–3 which depict primary embodiment 9 of the carpet stretching tool of the present invention. It will be seen that embodiment 9 extends longitudinally along longitudinal-axis 9A and generally comprises: a pair of barbed bars including a lead-bar 10 having barbs 16 for removably engaging leadward carpet length 8C and a trail-bar 20 having similar barbs 26 to removably engage trailward carpet length 8D, the sharp-ends of convergent barbs 16 and 26 collectively defining the tool horizontal bottom-plane 9B, guide means 30 relegated above bottom-plane 9B and including a collar 31 attached atop lead-bar 10 and also including a longitudinal shank 35 attached (35W) to trail-bar 20 and slidably surrounded by collar 31; and force application means 40 relegated above bottom-plane 9B and including longitudinally extending threaded stud 45 firmly attached (45W) to lead-bar 10 and passing through trail-bar enlarged aperture 22A and further including a handle 41 threadedly engaged with stud 45 and adapted to controllably force trail-bar 20 toward lead-bar 10.

Laterally extending lead-bar 10 is shown of rectangularly tubular configuration having an internal bore 10K, having a pair of ends 10M and 10N, having a pair of upright sides including leading side 11 and trailing side 12, and having a pair of horizontal sides including top-side 13 and bottom-side 14, barbs 16 being carried by a horizontal barb-plate 15 attached to bottom-side 14. Laterally extending trail-bar 20 is shown of similar rectangularly tubular configuration having an internal bore 20K, having a pair of ends 20M and 20N, having a pair of upright sides including leading side 21 and trailing side 22, and having a pair of horizontal sides including top-side 23 and bottom-side 24, barbs 26 being carried by a horizontal barbed-plate 25 attached to bottom-side 24. Substantially midway ends 20M and 20N and through upright sides 21 and 22, trail-bar 20 is provided with longitudinally extending (9A) enlarged aperture 22A to surround threaded stud 45.

It is the purpose of the guide means (e.g. 30) to permit the inherent longitudinal (9A) movement (22A) between the two laterally extending barbed bars (e.g. 10,20) while maintaining them in substantial parallelism. The guide means is located in elevation above the downwardly extending convergent barbs (e.g. 16,26) and preferably too above the force application means (e.g. stud 45). Guide means 30 for embodiment 9 includes a collar 31 extending upwardly from a barbed bar (e.g. 10) and rigidly attached thereto, as by welding, and further includes a longitudinally extending shank 35 slidably surrounded by collar bore 31K and similarly rigidly attached to the other barbed bar (e.g. 20). Cross-sectional shapes of collar bore 31K and shank 35 are desireably geometrically and dimensionally similar, rectangular or other polygonal shape being preferred. The internally cross-sectionally rectangular collar 31 rests atop and is rigidly attached to planar top-side 13 of lead-bar 10, and the planar underside of shank 35 at its trailward end 37 is rigidly attached (e.g. weld 35W) to planar top-side 23 of trail-bar 20. Longitudinally extending shank 35 is of sufficient length 36–37 that its leadward end 36 is always positioned leadwardly of collar 31.

It is the purpose of the force application means (e.g. 40) to controllably forceably initiate longitudinal relative movement between the carpet engageable barbed bars until the carpet lengths (8C, 8D) upon flooring 9F attain abuttment. The force application means is located in elevation wholly above said barbs (16,26) and preferably includes control means (e.g. handle 41) governing the desired distance between the barbed bars. Force application means 40 for embodiment 9 comprises a longitudinally extending threaded stud 45 having its leading-end 46 rigidly attached to lead-bar 10, as by welding 45W to upright wall 12. Non-twistable stud 45 extends through the relatively cross-sectionally enlarged apertures 22A of walls 21–22 whereby trail-bar 20 is free to move along stud 45. In order to prevent the threads of stud 45 from being worn by trail-bar apertures 22A, and to help maintain the sharp-ends of barbs 26 within plane 9B, a short bushing 49 having a bore smaller than 22A surrounds stud 45 and is rigidly attached to upright wall 21 of trail-bar 20. Longitudinally extending stud 45 of sufficient length 46–47 that its handled trailing-end 47 is always positioned trailwardly of trail-bar 20. Handle part 41 of force means 40 includes a threaded bore threadedly engaged with the trailmost length of stud 45 including at trailing-end 47. Handle 41 has radial ears 43 to facilitate its manual twisting so that handle leadward-end 41L, which is disconnected from trail-bar 20, bears against upright wall 22 to force the carpet engaging trail-bar 20 toward lead-bar 10. Thus, the number of twists for handle 41 controls the forceably reduced distance between the carpet engageable barbed bars.

Operation of the carpet stretching tool embodiment 9, though having already been alluded to, might be summarized as follows. The tool task is to bring carpet length 8D from its phantom line position to its solid line position that becomes abutting with carpet length 8C. Thus, the operator twists handle 41 so its leadward-end 41L approaches stud trailing-end 47 whereby trail-bar 20 might be moved away from lead-bar 10 to assume the phantom line position of FIGS. 1 and 2. As also indicated in phantom lines, the barbs 16 and 26 are removably engaged with carpet lengths 8C and 8D, respectively. Finally, the operator twists handle 41 so its leadward-end 41L bears against trail-bar wall 22 to progressively force barbed bar 20 toward lead-bar 10. Thus, as indicated in solid lines in FIGS. 1 and 2, carpet lengths 8C and 8D might become ultimately forced into abutting proximity by the relatively movable barbed bars that have been maintained parallel by the guide means.

Prior art carpet stretching tools of the barbed bars type are not readily amenable to the performance, between the bars, of an ancillary task at the abuttably stretched carpet, such as the task of carpet anchoring to the underlying flooring (9F). However, with the concepts of the present invention, the guide means and the force means might serve together as the sole and loftily-arched longitudinal connection between the barbed bars, thus overcoming such prior art deficiencies. In this vein, carpet stretching tool embodiment 99 of FIG. 4 differs from embodiment 9 in that barbed bars 10 and 20 are centrally provided with sturdy upstanding towers 50 and 60, respectively, whereby the guide and force means might be desireably loftily elevated. Lead-tower 50 includes upright leading side 51, upright trailing side 52, bottom-end 54, and top-end 53. Lead-tower bottom-end 54 is rigidly attached, as by welding, in upright relationship to lead-bar top-side 13, and rigidly carries non-rotatable collar 31 at its top-end 53. Analagously, trail-tower 60 includes upright leading side 61, upright trailing side 62, a bottom-end 64 at trail-bar 20, and a top-end 63. Trail-tower 60 is similarly rigidly attached in upright relationship to trail-bar top-side 23, and rigidly (35W) carries the non-rotatable longitudinal shank 35 at tower top-end 63. Towers 50 and 60 are desireably of substantially equal heighths 53–54, 63–64, each tower height providing at least three-fourths the overall height of embodiment 99 above its bottom-plane 9B.

The force application means for embodiment 99 immediately underlies the guide means, and hence, is located nearer the lofty towers top-ends (53,63) than to the underlying barbed bars. For such force means, threaded stud 45 passes through lead-tower 50 and its threaded leadward-end 46 is firmly removably associated to lead-tower leading side 51 with threaded nut 45N located thereat, nut 45N in counterdistinction to weld 45W facilitating replacement of a worn stud 45. Additionally, stud 45 passes through longitudinal aperture 62A of trail-tower immediately below its top-end 63. Thus, the guide and force application means provide the sole and loftily-arched longitudinally-extending (45E) connection between the barbed bars for tool embodiment 99. Accordingly, embodiment 99 accommodates between the barbed bars (10,20), and below the lofty connection means (30,40), laterally extending ancillary manual operations performable at the stretchably abutting carpet lengths (8C,8D). Though the manual operation alluded to in FIG. 4 arbitrarily refers to a seam ironing tool ("PI") ancillary task, other type manual operations might be similarly performed at the stretched abutting caroet lengths while tool 99 remains removably secured thereat.

In order to preserve the aesthetic appearance of the carpet being stretched, the carpet laying tools should not employ amorphous lubricants at the movably associated parts. In this vein, friction might be minimized at the guide means collar bore 31K by utilizing therein a replaceable sleeve 34 of Nylon, Teflon, or other low-friction resinous material.

Referring now back to FIG. 3, which indicates that one or both of the barbed bars might be of selectively variable laterally extending barbed length, as to be dictated by the abutting caroets length. In this vein, a plurality of barbed bar sections in removably secured linear relationship are employed. For the preferred barbed bars having the previously alluded to non-circular tubular configuration, the extension section e.g. 120, might be of similar size and geometric shape to permit insertion into bores 10K and 20K, as indicated by double-headed arrows in FIG. 3. Though each extension, particularly at its insertable end 120N, is preferably geometrically and dimensionally similar to bores 10K and 20K so as to permit slidable and non-turning engagement between the extensions and the barbed bars, set-screws 22S might be additionally employed to augment the engagements. Typical extension 120 has an upper side 123, and has a lower side 124 having a shim-plate 125 thereat which is co-planar with bar bottom-sides 14 and 24. The lateral length 120M–120N of an extension (120) is empirically selectable whereby the overall laterally extending barbed length can be chosen according to the exigiencies of the carpet laying task.

From the foregoing, the construction and operation of the carpet stretching tools will be readily understood and further explanation is believed to be unnecessary. However, since numerous modifications and changes will readily occur to those skilled in the art, it is not desired to limit the invention to the exact constructions shown and described, and accordingly, all suitable modifications and equivalents may be resorted to, falling within the scope of the appended claims.

What is claimed is as follows:

1. A carpet stretching tool extending along a horizontal longitudinal-axis and comprising:

A. a pair of laterally extending and substantially parallel barbed bars including a lead-bar longitudinally spaced from a trail-bar, each barbed bar including a plurality of downwardly extending barbs having sharp-ends collectively defining the tool horizontal bottom-plane and being adapted to removably engage distinct terminal lengths of carpet to be stretched into proximity;

B. longitudinally extending guide means attached to the respective barbed bars and located in elevation above the downwardly extending barbs, said guide means being adapted to permit relative longitudinal movement between the carpet engaging barbed bars while also maintaining them in substantial upright parallelism, said guide means comprising a cross-sectionally non-circular collar extending upwardly from one of the barbed bars and a cross-sectionally non-circular longitudinally extending shank attached to the other barbed bar and slidably extending through said collar; and C. force application means attached to the respective barbed bars and occupying a distinct elevation located intermediate the downwardly extending barbs and said guide means shank, said force application means being adapted to cause relative longitudinal movement between the carpet engaging barbed bars through said guide means and including:

i. a longitudinally extending elongate threaded stud located in elevation below said guide means longitudinal shank, said stud being firmly attached to one of the barbed bars and being movably surrounded by the other barbed bar; and ii. a handle threadedly engaged with said elongate stud remote from the stud attachment and adapted to apply direct pressure upon the movable barbed bar as said handle is moved along the threaded stud whereby the movable barbed bar is caused by said handle to move toward the stud attached barbed bar.

2. The carpet stretching tool of claim 1 wherein there are loftily-arched and longitudinally extending connection means between the barbed bars, said connection means including the guide means and the force application means whereby the tool accommodates laterally extending manual operations to the proximal carpet terminii along the tool bottom-plane between the barbed bars.

3. The carpet stretching tool of claim 1 wherein the laterally extending barbed length of at least one of the barbed bars is selectively variable and comprises a plurality of barbed bar sections in removably secured linear relationship, at least one section being of non-circular configuration to removably receive the end of another barbed bar section.

4. The tool of claim 1 wherein the guide means collar is attached to the lead-bar; wherein the guide means shank is attached to the trail-bar; wherein the threaded stud has a leading-end firmly attached to the lead-bar, said threaded stud being slidably surrounded by a bushing rigidly attached to the trail-bar; and wherein the force application means handle has a leadward-end physically disconnected from the trail-bar but which is adapted to force the movable trail-bar toward the lead-bar.

5. The tool of claim 1 wherein there are loftily-arched and longitudinally extending connection means between the barbed bars, said connection means including the guide means and the force application means whereby the tool accommodates laterally extending manual operations to the proximal carpet terminii along the tool bottom-plane between the barbed bars.

6. The tool of claim 4 wherein there are loftily-arched and longitudinally extending connection means between the lead-bar and trail-bar, said connection means including the longitudinal shank of the guide means and the threaded stud of the force application means whereby the tool accommodates therebelow laterally extending manual operations to the proximal carpet terminii.

7. The tool of claim 6 wherein a lofty lead-tower extends uprightly between the lead-bar and the guide means collar; and wherein a lofty trail-tower extends uprightly between the trail-bar and the guide means shank, said lead-tower and said trail-tower being of substantially equal heighths and respectively providing at least three-fourths the overall tool height above the bottom-plane thereof.

8. The carpet stretching tool of claim 1 wherein the downwardly extending barbs of the lead-bar and the trail-bar converge toward each other; and wherein the force application means threaded stud is removably associated with the lead-bar, said threaded stud being slidably surrounded by a bushing rigidly associated with the trail-bar.

* * * * *